US009023779B2

(12) United States Patent
Miralles

(10) Patent No.: US 9,023,779 B2
(45) Date of Patent: May 5, 2015

(54) INHIBITING CORROSION OF ALUMINUM ON CONSUMER WARE WASHING PRODUCT USING PHOSPHINOSUCCINIC ACID OLIGOMERS

(71) Applicant: Ecolab USA Inc., St. Paul, MN (US)

(72) Inventor: Altony J. Miralles, Woodbury, MN (US)

(73) Assignee: Ecolab USA Inc., Saint Paul, MN (US)

( * ) Notice: Subject to any disclaimer, the term of this patent is extended or adjusted under 35 U.S.C. 154(b) by 112 days.

(21) Appl. No.: 13/834,219

(22) Filed: Mar. 15, 2013

(65) Prior Publication Data

US 2014/0261564 A1 Sep. 18, 2014

(51) Int. Cl.

| | |
|---|---|
| ***C11D 3/08*** | (2006.01) |
| ***C11D 7/06*** | (2006.01) |
| ***C11D 7/36*** | (2006.01) |
| ***B08B 3/04*** | (2006.01) |
| ***C11D 3/36*** | (2006.01) |
| ***C11D 3/00*** | (2006.01) |
| ***C11D 3/37*** | (2006.01) |

(52) U.S. Cl.

CPC ..... *C11D 3/365* (2013.01); *C11D 3/0073* (2013.01); *C11D 3/3757* (2013.01); *C11D 3/3784* (2013.01)

(58) Field of Classification Search

CPC ..... C11D 3/08; C11D 3/365; C11D 3/378; C11D 7/06; C11D 7/36; B08B 3/04

USPC ..... 510/223, 225, 228, 229, 467, 476; 134/25.2, 25.3, 39, 40, 42

See application file for complete search history.

(56) References Cited

U.S. PATENT DOCUMENTS

| | | | |
|---|---|---|---|
| 4,632,741 | A | 12/1986 | Wolf et al. |
| 4,935,065 | A | 6/1990 | Bull |
| 5,023,000 | A | 6/1991 | Kneller et al. |
| 6,207,079 | B1 | 3/2001 | Kmec et al. |
| 6,348,440 | B1 | 2/2002 | Meskers, Jr. et al. |
| 6,403,028 | B1 | 6/2002 | Colby et al. |

(Continued)

FOREIGN PATENT DOCUMENTS

| | | | |
|---|---|---|---|
| EP | 1 129 038 | B1 | 5/2001 |
| WO | WO 99/67177 | A1 | 12/1999 |

(Continued)

OTHER PUBLICATIONS

Ecolab USA Inc., PCT/US2014/019992 filed Mar. 3, 2014, "The International Search Report and the Written Opinion of the International Searching Authority, or the Declaration", mailed Jul. 18, 2014.

(Continued)

*Primary Examiner* — Brian P Mruk

(74) *Attorney, Agent, or Firm* — McKee, Voorhees & Sease, P.L.C.

(57) ABSTRACT

A dishwashing detergent composition is provided for consumer use for in cleaning of alkaline sensitive metals such as aluminum or aluminum containing alloys. The compositions include alternatives to sodium tripolyphosphate and/or other phosphorus containing raw materials, while retaining cleaning performance and corrosion prevention. According to the invention, a phosphinosuccinic acid oligomer or mixture thereof is used as a corrosion inhibitor and can be included for aluminum protection in a number of different detergent compositions.

20 Claims, 2 Drawing Sheets

First Cycle

(56) References Cited

U.S. PATENT DOCUMENTS

| | | | |
|---|---|---|---|
| 6,464,900 | B1 | 10/2002 | Kmec et al. |
| 6,572,789 | B1 | 6/2003 | Yang et al. |
| 6,585,933 | B1 | 7/2003 | Ehrhardt et al. |
| 6,887,597 | B1 | 5/2005 | Yang et al. |
| 7,179,384 | B2 | 2/2007 | Moriarty et al. |
| 7,442,676 | B2 | 10/2008 | Yang et al. |
| 7,828,902 | B2 | 11/2010 | Kinnaird et al. |
| 8,025,840 | B2 | 9/2011 | Crovetto et al. |
| 8,216,383 | B2 | 7/2012 | Yang et al. |
| 2003/0216275 | A1 | 11/2003 | Crump et al. |
| 2006/0097229 | A1 | 5/2006 | Grech et al. |
| 2010/0111756 | A1 | 5/2010 | Crovetto et al. |
| 2010/0116473 | A1 | 5/2010 | Yang et al. |
| 2011/0071065 | A1 | 3/2011 | Silvernail et al. |
| 2011/0253628 | A1 * | 10/2011 | Blokker et al. ..... 210/638 |
| 2012/0216834 | A1 | 8/2012 | Yang et al. |

FOREIGN PATENT DOCUMENTS

| | | | |
|---|---|---|---|
| WO | WO 01/79215 | A1 | 10/2001 |
| WO | WO 2009/055377 | A1 | 4/2009 |

OTHER PUBLICATIONS

Ecolab USA Inc., PCT/US2014/020002 filed Mar. 3, 2014, "The International Search Report and the Written Opinion of the International Searching Authority, or the Declaration", mailed Jul. 18, 2014.

Branzoi, Viorel, et al., "Corrosion Protection of Industrial Cooling Water Systems by Using New Organic Polymers as Inhibitors", Revue Roumaine de Chimie, 2008, 53(6), pp. 459-469.

* cited by examiner

First Cycle

Second Cycle

Third Cycle

Fourth Cycle

Fifth Cycle

INHIBITING CORROSION OF ALUMINUM ON CONSUMER WARE WASHING PRODUCT USING PHOSPHINOSUCCINIC ACID OLIGOMERS

FIELD OF THE INVENTION

The invention relates to corrosion inhibiting compositions and detergent and cleaning compositions incorporating the same, particularly consumer warewashing compositions comprising phosphinosuccinic acid oligomers, their salts and/or mixtures thereof for cleaning of alkaline sensitive metals such as aluminum, tin, or aluminum or tin containing alloys.

BACKGROUND OF THE INVENTION

In recent years there has been an ever increasing trend towards safer and environmentally friendly detergent compositions. This has led to development of alternative complexing agents (builders), which are used instead of predominantly phosphorus based builders. Phosphates can bind calcium and magnesium ions, provide alkalinity, act as threshold agents, and protect alkaline sensitive metals such as aluminum and aluminum containing alloys.

Other corrosion inhibitors include silicates, such as, sodium silicate. For silicates to work, it is necessary to use high concentrations of silicate. As the concentration of silicates increase, so increases the pH. As the pH increases, the corrosivity of the solution toward soft metals also increases, requiring even more concentration of silicates. High concentration of silicates then increase the precipitation of magnesium and calcium salts, forcing the use of very high concentration of materials that will control the precipitation of those salts.

It is an object of the invention to address at least one of the above problems and/or to offer detergent compositions with usage and/or environmental benefits.

SUMMARY OF THE INVENTION

In one embodiment, the present invention relates to a corrosion inhibiting composition that may be used in formulation of detergents, cleaning compositions, and in protecting aluminum, or tin and aluminum or tin containing alloys from corrosion. The corrosion inhibiting composition comprises phosphinosuccinic oligomers. According to the invention, oligomers achieve corrosion inhibition and cleaning in detergent compositions without the need for phosphorus containing components.

In one embodiment a detergent composition is provided according to the invention. The detergent composition including a consumer compatible alkalinity source, (such as carbonate) an acrylic copolymer, an adjuvant, and at least one phosphinosuccinic oligomer for corrosion inhibition. The alkaline source can be provided in an amount effective to provide a use composition having a pH of at least about 8. The mix of phosphinosuccinic oligomers is provided in an amount sufficient to reduce corrosion of aluminum, tin, and/or aluminum or tin containing alloys at a pH of about 8 or greater.

Articles which require such cleaning according to the invention includes any article with a surface that contains an alkaline sensitive metal, such as, aluminum tin or aluminum or tin containing alloys. Such articles can be found in kitchens, and restaurants and the like. Exemplary equipment having a surface containing an alkaline sensitive metals include sinks, cookware, utensils, vehicles, vehicle wheels, work surfaces, tanks, immersion vessels, spray washers, and ultrasonic baths. In addition, a detergent composition is provided according to the invention that can be used in environments other than inside a dishwashing machine. Alkali sensitive metals in need of cleaning are found in several locations. Exemplary locations also include trucks, vehicle wheels, ware, and facilities. Compositions including the novel corrosion inhibitor of the invention may be used in any of these consumer applications.

The invention also includes methods for cleaning aluminum or tin and/or aluminum or tin containing alloys by contacting the surface of the same with the detergent/cleaning compositions of the invention. The detergent/cleaning compositions include an alkalinity source, an acrylic copolymer, an adjuvant, and a phosphinosuccinic acid oligomer, its salts or mixtures thereof, (often referred to as PSO) for corrosion inhibition.

The invention also includes methods for protecting aluminum or tin and/or aluminum or tin containing alloys from corrosion by use of the novel corrosion inhibiting composition of the invention. The method involves the step of contacting the surface of aluminum or tin and/or aluminum or tin containing alloys with the corrosion inhibiting composition of the invention. The novel corrosion inhibiting composition includes one or more phosphinosuccinic acid oligomers or a mixture thereof. Also included is a method for manufacturing a warewashing detergent composition. The method can include a step of adding a corrosion inhibitor comprising a phosphinosuccinic acid oligomers to a warewashing detergent composition. The corrosion inhibitor can be added to the warewashing detergent composition when the warewashing detergent composition is a concentrate and/or when the warewashing detergent composition is a use composition. Also in a preferred embodiment the warewashing detergent includes an alkalinity source, an acrylic copolymer, an adjuvant, and a phosphinosuccinic acid oligomer, or mixtures thereof for corrosion inhibition.

The composition generally includes from about 5 to about 300 ppm of oligomeric phosphinosuccinic acid mixture; from about 5 to about 300 ppm of the acrylic copolymer; from about 10 to about 1000 ppm adjuvant and from about 500 to 2000 ppm alkalinity.

DETAILED DESCRIPTION OF THE FIGURES

DETAILED DESCRIPTION OF THE INVENTION

Figure 1A:
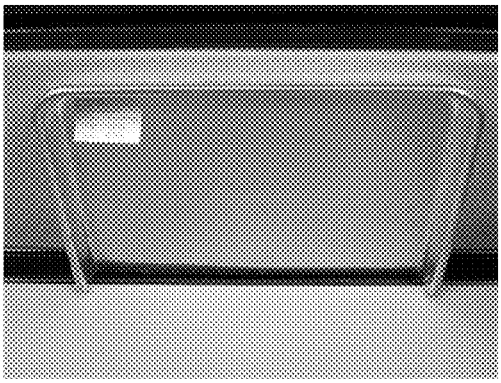
FIG. 1A-1E are photographs aluminum trays after 100 cycles using the detergent of the invention. No corrosion is seen with treatment of the detergent of the invention.

In this specification and in the claims that follow, reference will be made to a number of terms that shall be defined to have the following meanings:

The phrase "alkaline sensitive metal" identifies those metals that exhibit corrosion and/or discoloration when exposed to an alkaline detergent in solution. An alkaline solution is an aqueous solution having a pH that is greater than 8. Exemplary alkaline sensitive metals include soft metals such as aluminum, tin, zinc, copper, and mixtures thereof. Aluminum and aluminum alloys are common alkaline sensitive metals that can be cleaned by the warewash detergent compositions of the invention.

As used herein, weight percent (wt-%), percent by weight, % by weight, and the like are synonyms that refer to the concentration of a substance as the weight of that substance divided by the total weight of the composition and multiplied by 100.

As used herein, the term "about" modifying the quantity of a component or ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities.

The term "surfactant" or "surface active agent" refers to an organic chemical that reduces surface tension when dissolved in water or water solutions, or which reduces interfacial tensions between two liquids, or between a liquid and a solid.

"Cleaning" means to perform or aid in soil removal, bleaching, microbial population reduction, rinsing, or combination thereof.

As used herein, the term "substantially free" refers to compositions completely lacking the component or having such a small amount of the component that the component does not affect the effectiveness of the composition. The component may be present as an impurity or as a contaminant and shall be less than 0.5 wt. %. In another embodiment, the amount of the component is less than 0.1 wt-% and in yet another embodiment, the amount of component is less than 0.01 wt. %.

As used herein, the term "ware" includes items such as eating and cooking utensils. As used herein, the term "warewashing" refers to washing, cleaning, or rinsing ware.

The term "oligomer" refers to a polymer molecule consisting of only a few monomer units (dimer, trimer, tetramer).

As used herein, a "solid" cleaning composition refers to a cleaning composition in the form of a solid such as a powder, a particle, an agglomerate, a flake, a granule, a pellet, a tablet, a lozenge, a puck, a briquette, a brick, a solid block, a unit dose, or another solid form known to those of skill in the art. The term "solid" refers to the state of the detergent composition under the expected conditions of storage and use of the solid detergent composition. In general, it is expected that the detergent composition will remain in solid form when exposed to temperatures of 100° F. and preferably 120° F. A cast, pressed, or extruded "solid" may take any form including a block. When referring to a cast, pressed, or extruded solid it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition can range from that of a fused solid block, which is relatively dense and hard, for example, like concrete, to a consistency characterized as being malleable and sponge-like, similar to caulking material.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the terms "sodium tripolyphosphate-free" or "STPP-free" refers to a composition, mixture, or ingredients that do not contain tripolyphosphates or to which the same has not been added. Should sodium tripolyphosphate or—other phosphate containing compounds be present through contamination of a composition, mixture, or ingredients, the amount of the same shall be less than 0.5 wt. %. In another embodiment, the amount of is less than 0.1 wt-% and in yet another embodiment, the amount is less than 0.01 wt. %.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

According to one embodiment of the invention a detergent composition is provided comprising phosphinosuccinic acid oligomers; an acrylic copolymer; an adjuvant and a consumer friendly source of alkalinity. In a preferred embodiment the invention includes a mix of phosphinosuccinic oligomers from about 5 to about 300 ppm of the phosphinosuccinic oligomers; from about 10 to about 1000 ppm adjuvant and from about 500 to 2000 ppm alkalinity at the use concentration.

The warewash detergent composition can be made available as numerous different concentrates that are diluted and combined at the situs of use to provide a use solution for application to alkaline sensitive metals. An advantage of providing concentrates that are later combined is that shipping and storage costs can be reduced because it can be less expensive to ship and store a concentrate rather than a use solution and is also more sustainable because less packaging is used. Although the warewash detergent composition according to the invention can be provided as multiple concentrates, it should be understood that the composition can be provided as a ready to use solution. In addition, the multiple concentrates can include two or more concentrates that are added together. In addition, the concentrates can be provided in the form of a liquid solid, paste, granulate, or powder.

Source of Alkalinity

The source of alkalinity can be any source of alkalinity that is compatible with consumer use and the other components of the detergent composition and that will provide a use solution with the desired pH. Exemplary sources of alkalinity include alkali metal hydroxides, alkali metal oxides, alkali metal salts, silicates, phosphates, amines, and mixtures thereof. Exemplary alkali metal hydroxides include sodium hydroxide, potassium hydroxide, and lithium hydroxide. The alkali metal hydroxide may be added to the composition in a variety of forms, including for example in the form of solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 45 wt. %, 50 wt. % and a 73 wt. % solution.

Exemplary alkali metal salts include sodium carbonate, trisodium phosphate, potassium carbonate, and mixtures thereof. Exemplary silicates include sodium metasilicates, sesquisilicates, orthosilicates, potassium silicates, and mixtures thereof. Exemplary phosphates include sodium pyrophosphate, potassium pyrophosphate, and mixtures thereof. Exemplary amines include alkanolamine. Exemplary alkanolamines include triethanolamine, monoethanolamine, diethanolamine, and mixtures thereof. In a preferred embodiment the source of alkalinity is carbonate.

The source of alkalinity is provided in an amount sufficient to provide the use solution with a pH of at least 8.0. The use solution pH range is preferably between about 8.0 and about 13.0, and more preferably between 10.0 to 12.5. In general, the amount of the source of alkalinity provided in the alkaline concentrate can be provided in an amount of at least about 0.05 wt. % based on the weight of the alkaline concentrate. The source of alkalinity can be provided in the alkaline use solution in an amount of between about 100 to about 3000 ppm.

Phosphinosuccinic Oligomers

The invention comprises a novel corrosion inhibitor component, phosphinosuccinate oligomers. The corrosion inhibitor component effectively reduces corrosion to alkaline sensitive metals such as aluminum, tin or aluminum or tin containing alloys at a pH of about 8 or greater.

According to an embodiment of the present invention, phosphinosuccinate oligomers are used as a corrosion inhibitor. The phosphinic acid-based corrosion inhibitor of this invention is a composition comprising phosphinosuccinate oligomers of formulas I, II, and III.

I

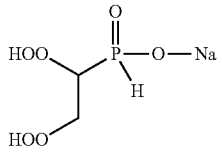

II

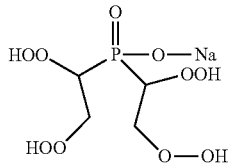

III

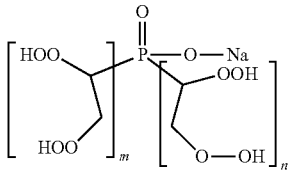

While the oligomers of formula I, II and III are represented above as neutral, organophosphinic acid species, it is understood that the phosphinic and carboxylic acid groups may also exist in salt form. In addition to the phosphinosuccinic acids and oligomeric species, the mixture may also contain some phosphonosuccinic acid derivatized from the oxidation of adduct I, as well as impurities such as various inorganic phosphorus byproducts of formula $H_2PO_2^-$, $HPO_3^{2-}$ and $PO_4^{3-}$.

Possible structures for the oligomeric species are proposed in U.S. Pat. Nos. 5,085,794, 5,023,000 and 5,018,577. In addition, the oligomeric species may also contain esters of phosphonosuccinic acid, where the phosphonate group is esterified with a succinate-derived alkyl group.

In a preferred embodiment the corrosion inhibitor includes a combination of monosodium phosphinicosuccinic acid, monosodium phosphinicobis(succinic) acid and phosphinicopolysuccinic acid. In a more preferred embodiment the adducts comprises from about 5 to about 25 wt. % of monosodium phosphinosuccinic acid, from about 20 to about 60 wt. % of monosodium phosphinobis(succinic) acid and from about 40 to 75 wt. % of a phosphinopolysuccinic acid. In a more preferred embodiment the adducts are a mixture having the formula depicted below:

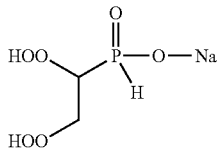

Monosodium Phosphinicosuccinic Acid 13.5%

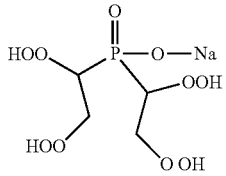

Monosodium Phosphinicobis(Succinic) Acid 39.1%

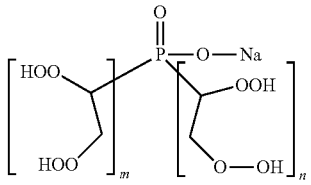

Phosphinicosuccinic Acid Oligomer 45.7%
Total P = 2.97%

Where m+n is_>2.

Similar polymers are described in U.S. Pat. No. 6,572,789 particularly column 5, the disclosure of which is hereby incorporated by reference.

Acrylic Copolymer

The matrices and solid detergent compositions include acrylic acid copolymer.

Acrylic acid copolymers are described with respect to the at least two monomer units of the compound(s). The acrylic acid polymers according to the invention include two of the following monomer units: acrylic acid, 2-acrylamido-2-methylpropane sulfonic acid (AMPS), polyethylene glycol (PEG), methacrylic acid, itaconic acid and maleic acid. According to aspects of the invention, the acrylic acid copolymer includes an acrylic acid monomer and an additional monomer units of 2-acrylamido-2-methylpropane sulfonic acid (AMPS). The acrylic acid monomeric unit has the general formula (I) below:

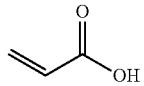

wherein the unsaturated carboxylic acid may be further combined with acrylic acid monomers and/or its esters to form polyacrylic acids by reacting at the double bond site of the monomer.

The AMPS monomeric unit has the general formula (II) below:

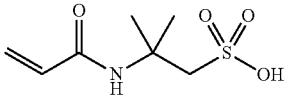

Acrylic Acid copolymer

| | | | |
|---|---|---|---|
| Acrylic Acid | 0-90 wt-% | 10-80 wt-% | 60-80 wt-% |
| AMPS | 0-50 wt-% | 1-30 wt-% | 10-30 wt-% |

In an aspect of the invention, the ratio of the acrylic acid monomeric unit to the AMPS monomeric unit is from about 1:1 to about 20:1, preferably from about 2:1 to about 10:1, preferably from about 3:2 to about 10:2. According to additional aspects of the invention, the copolymer may further include additional monomer units.

According to still further aspects of the invention, the polymer may include the acrylic acid monomer unit along with additional monomer units selected from the group consisting of 2-acrylamido-2-methylpropane sulfonic acid (AMPS), polyethylene glycol (PEG), methacrylic acid, itaconic acid and maleic acid. Without limiting the scope of the invention, the numeric ranges of the ratios recited are understood to be inclusive of the numbers defining the range of the ratios and include each integer within the defined range.

In an aspect of the invention, the molecular weights of the polymers are between about 500 g/mol to 100,000,000 g/mol. In an aspect of the invention, the molecular weights of the polymers are between about 500 g/mol to 50,000,000 g/mol. In a further aspect of the invention, the molecular weights of the polymers are between about 500 g/mol to 25,000,000 g/mol. In a still further aspect of the invention, the molecular weights of the polymers are between about 500 g/mol to 5,000,000 g/mol. Without limiting the scope of the invention, the numeric ranges of molecular weights recited are understood to be inclusive of the numbers defining the range and include each integer within the defined range. Examples of commercially available acrylic polymers useful in the invention include: Aquatreat AR-545, Aquatreat AR-546, made by AKZO NOBEL, 525 W Van Buren St Chicago, 1 L 60607, United States of America; Acumer 2000, Acumer 2100, made by The Dow Chemical Company, 100 Independence Mall West Philadelphia, Pa. 19106-2399, United States of America; and Sokalan CP-50, made by BASF Corporation, 100 Park Avenue, Florham Park, N.J. 07932, United States of America.

The acrylic polymer is present in the use composition in an amount of from about 5 to 300 ppm.

Adjuvant

The invention also includes an adjuvant. The adjuvant can be a carboxylate, polycarboxylate, amino acid, hydroxycarboxylate, polyhydroxycarboxylate, chelant, polyhydroxide, etc., and their salts, like: catechol, curcumin, tiron, maleic acid, tartaric acid, saccharates, phthalic acid, lactic acid, glucose, salicylic acid, malic acid, mucic acid, gluconic acid, aspartic acid, methoxycathecol, oxalic acid, polyaspartic acid, EDTA, methylglycinediacetate (MGDA), glutamic aciddiacetate (GLDA), even phosphates and polyphosphates. In a preferred embodiment the adjuvant is sodium citrate. In a preferred embodiment the adjuvant is gluconate, citrate, or tartrate.

In some embodiments the adjuvant also includes a silicate. Exemplary silicates include sodium metasilicates, sesquisilicates, orthosilicates, potassium silicates, silicates where the Weight Ratio $SiO_2/Na_2O$ varies between about 3.5 to 0.5, and mixtures thereof.

The adjuvant is present in the composition in an amount of 10-5000 ppm

Additional Functional Ingredients

The compositions may also include additional materials, such as additional functional materials, for example, an additional source of alkalinity, an additional surfactant, an additional chelating agent, anticorrosion agents, a sequestering agent, a bleaching agent, a thickening agent, a solubility modifier, a detergent filler, wetting agents, enzymes, foam inhibitors, antiredeposition agents, anti-etch agents, antimicrobial agents, a threshold agent or system, an aesthetic enhancing agent (i.e. dye, perfume, etc.) and the like, or combinations or mixtures thereof including other ingredients useful in imparting a desired characteristic or functionality in the detergent composition.

Adjuvants and other additive ingredients will vary according to the type of composition being manufactured and can be included in the compositions in any amount. In at least some embodiments, any additional functional materials that are added to the composition are compatible with the other components within the composition. Other active ingredients may optionally be used to improve the effectiveness of the detergent composition. The following describes some examples of such ingredients.

Surfactants

The methods and compositions of the invention comprise a surfactant or in particular embodiments an additional surfactant. Surfactants include water soluble or water dispersible nonionic, semi-polar nonionic (supra), anionic, cationic, amphoteric, or zwitterionic surface-active agents; viscoelastic surfactants or any combination thereof. A typical listing of the classes and species of surfactants useful herein appears in U.S. Pat. No. 3,664,961 issued May 23, 1972, to Norris.

Nonionic Surfactants

The surfactant is preferably a nonionic surfactant. Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkyl oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from 1,000 to 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from 500 to 7,000; and, the hydrophile, ethylene oxide, is added to constitute from 10% by weight to 80% by weight of the molecule.

2. Condensation products of one mole of alkyl phenol wherein the alkyl chain, of straight chain or branched chain configuration, or of single or dual alkyl constituent, contains from 8 to 18 carbon atoms with from 3 to 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from 6 to 24 carbon atoms with from 3 to 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol® manufactured by Shell Chemical Co. and Alfonic® manufactured by Vista Chemical Co.

4. Condensation products of one mole of saturated or unsaturated, straight or branched chain carboxylic acid having from 8 to 18 carbon atoms with from 6 to 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility. In a preferred embodiment the surfactant is a sorbitan ester.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from 1,000 to 3,100 with the central hydrophile including 10% by weight to 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from 2,100 to 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

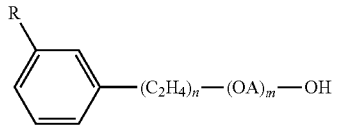

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxyl material, R is a radical derived from an alkyl oxide which can be ethylene and propylene and n is an integer from, for example, 10 to 2,000 or more and z is an integer determined by the number of reactive oxyalkyl groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from 1 to 6 carbon atoms and one reactive hydrogen atom, n has an average value of at least 6.4, as determined by hydroxyl number and m has a value such that the oxyethylene portion constitutes 10% to 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ wherein Y is the residue of an organic compound having from 2 to 6 carbon atoms and containing x reactive hydrogen atoms in which x has a value of at least 2, n has a value such that the molecular weight of the polyoxypropylene hydrophobic base is at least 900 and m has value such that the oxyethylene content of the molecule is from 10% to 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from 8 to 18 carbon atoms and containing x reactive hydrogen atoms in which x has a value of 1 or 2, n has a value such that the molecular weight of the polyoxyethylene portion is at least 44 and m has a value such that the oxypropylene content of the molecule is from 10% to 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R^2CONR^1Z$ in which: $R^1$ is H, $C_1$-$C_4$ hydrocarbyl, 2-hydroxy ethyl, 2-hydroxy propyl, ethoxy, propoxy group, or a mixture thereof; R is a $C_5$-$C_31$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from 0 to 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_{10}$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from 6 to 30 carbon atoms and a polysaccharide, e.g., a polyglycoside, hydrophilic group containing from 1.3 to 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use in the present compositions include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or—$(C_2H_4O)_xH$, where x is in the range of from 1 to 3.

13. A useful class of non-ionic surfactants includes the class defined as alkoxylated amines or, most particularly, alcohol alkoxylated/aminated/alkoxylated surfactants. These non-ionic surfactants may be at least in part represented by the general formulae:

$$R^{20}—(PO)_sN\text{-}(EO)_tH,$$

$$R_20\text{-}(PO)_sN\text{-}(EO)_tH(EO)_tH, \text{ and}$$

$$R^{20}—N(EO)_tH;$$

in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula:

$$R^{20}—(PO)_v—N[(EO)_wH][(EO)_zH]$$

in which $R^{20}$ is as defined above, v is 1 to 20 (e.g., 1, 2, 3, or 4 (preferably 2)), and w and z are independently 1-10, preferably 2-5.

These compounds are represented commercially by a line of products sold by Huntsman Chemicals as nonionic surfactants. A preferred chemical of this class includes Surfonic™ PEA 25 Amine Alkoxylate.

The treatise Nonionic Surfactants, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactants

The semi-polar type of nonionic surface active agents was described supra.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. As those skilled in the art understand, anionics are excellent detersive surfactants and are therefore favored additions to heavy duty detergent compositions. Generally, however, anionics have high foam profiles which limit their use alone or at high concentration levels in cleaning systems such as CIP circuits that require strict foam control. Anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989). The first class includes acylamino acids (and salts), such as acylglutamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$-$C_17$ acyl-N—($C_1$-$C_4$ alkyl) and —N—($C_1$-$C_2$ hydroxyalkyl)glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy)sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y—and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

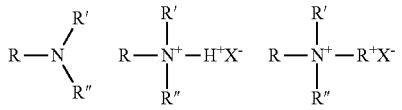

in which, R represents a long alkyl chain, R', R'', and R''' may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those of skill in the art and described in "Surfactant Encyclopedia," Cosmetics & Toiletries, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xYLZ$ wherein each $R^1$ is an organic group containing a straight or branched alkyl or alkenyl group optionally substituted with up to three phenyl or hydroxy groups and optionally interrupted by up to four of the following structures:

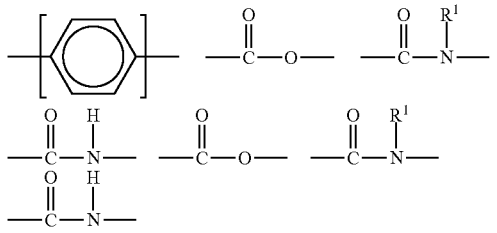

or an isomer or mixture of these structures, and which contains from 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group is filled by hydrogens.

Y can be a group including, but not limited to:

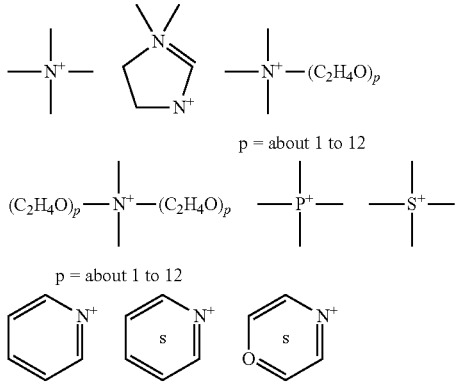

or a mixture thereof.

Preferably, L is 1 or 2, with the Y groups being separated by a moiety selected from $R^1$ and $R^2$ analogs (preferably alkylene or alkenylene) having from 1 to 22 carbon atoms and two free carbon single bonds when L is 2. Z is a water soluble anion, such as sulfate, methylsulfate, hydroxide, or nitrate anion, particularly preferred being sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of the anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," Cosmetics & Toiletries, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with ethyl acetate. During alkylation, one or two carboxyalkyl groups react to form a tertiary amine and an ether linkage with differing alkylating agents yielding different tertiary amines. Long chain imidazole derivatives having application in the present invention generally have the general formula:

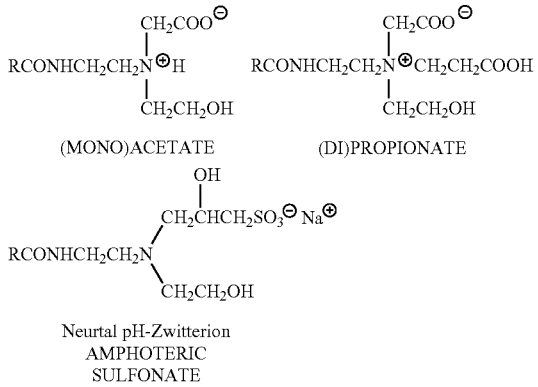

wherein R is an acyclic hydrophobic group containing from 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which R.dbd.$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl)alanine Examples of commercial N-alkylamino acid ampholytes having application in this invention include alkyl beta-amino dipropionates, $RN(C_2H_4COOM)_2$ and $RNHC_2H_4COOM$. In these, R is preferably an acyclic hydrophobic group containing from 8 to 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

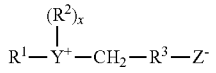

wherein R1 contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; R.sup.2 is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-car-boxylate; 5-[S-3-hydroxypropyl-5-hexadecylsulfonio]-3-hydroxypentane-1-sul-fate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propan-e-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxyl-ate; 3-[S-ethyl-S-(3-dodecoxy-2-hydroxypropyl)sulfonio]-propane-1-phosphat-e; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

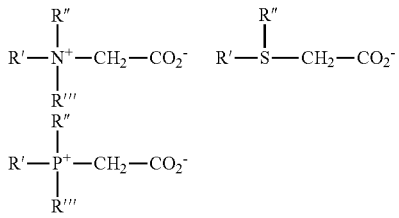

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N.sup.+R^2SO^3—$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

The composition of additional surfactant can be present in the range of approximately 0-10000 ppm in cleaning solutions at use concentrations.

Threshold Inhibitor/Crystal Modifier Component

The detergent composition may also include a threshold agent of crystal modifier. for reducing precipitation of calcium carbonate in the use solution. In general, it is expected that the threshold inhibitor/crystal modifier component will loosely hold calcium to reduce precipitation of calcium carbonate once it is subjected to a pH of at least 8.0.

Exemplary threshold inhibitor/crystal modifier components include phosphonocarboxylic acids, phosphonates, polymers, and mixtures thereof. Exemplary phosphonocarboxylic acids include those available under the name Bayhibit™ AM (2-phosphonobutane-1,2,4, tricarboxylic acid) (PBTC) from Bayer. Exemplary phosphonates include amino tri(methylene phosphonic acid), 1-hydroxy ethylidene 1-1-diphosphonic acid, ethylene diamine tetra(methylene phosphonic acid), hexamethylene diamine tetra(methylene phosphonic acid), diethylene triamine penta(methylene phosphonic acid), and mixtures thereof. Exemplary phosphonates are available under the name Dequest™ from Monsanto. Exemplary polymers include polyacrylates, polymethacrylates, polyacrylic acid, polyitaconic acid, polymaleic acid, sulfonated polymers, copolymers and mixtures thereof. It should be understood that the mixtures can include mixtures of different acid substituted polymers within the same general class. In addition, it should be understood that salts of acid substituted polymers can be used. The useful carboxylated polymers may be generically categorized as water-soluble carboxylic acid polymers such as polyacrylic and polymethacrylic acids or vinyl addition polymers. Of the vinyl addition polymers contemplated, maleic anhydride copolymers as with vinyl acetate, styrene, ethylene, isobutylene, acrylic acid and vinyl ethers are examples. The polymers tend to be water-soluble or at least colloidally dispersible in water. The molecular weight of these polymers may vary over a broad range although it is preferred to use polymers having average molecular weights ranging between 1,000 up to 1,000,000. These polymers have a molecular weight of 100,000 or less and between 1,000 and 10,000.

The polymers or copolymers (either the acid-substituted polymers or other added polymers) may be prepared by either addition or hydrolytic techniques. Thus, maleic anhydride copolymers are prepared by the addition polymerization of maleic anhydride and another comonomer such as styrene. The low molecular weight acrylic acid polymers may be prepared by addition polymerization of acrylic acid or its salts either with itself or other vinyl comonomers. Alternatively, such polymers may be prepared by the alkaline hydrolysis of low molecular weight acrylonitrile homopolymers or copolymers. For such a preparative technique see Newman U.S. Pat. No. 3,419,502.

The threshold inhibitor/crystal modifier component should be provided in an amount sufficient so that when it is in the use solution, it sufficiently prevents the precipitation of hardness, and other insoluble salts such as magnesium silicate, magnesium hydroxide and the like or disrupts crystal growth. The threshold inhibitor/crystal modifier component can be provided in an amount of at least about 0.0001 wt. %, and can be provided in a range of between about 0.0001 wt. % and about 25 wt. % based on the weight of the concentrate, and more preferably can be provided in a range of between about 0.001 wt. % and about 10 wt. % based on the weight of the concentrate and most preferably between about 0.01 and 8% based on the weight of the concentrate. It should be understood that the polymers and the phosphonocarboxylates and phosphinates can be used alone or in combination.

Dye or Odorant

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like. Fragrances or perfumes that may be included in the compositions include, for example, terpenoids such as citronellol, aldehydes such as amyl cinnamaldehyde, a jasmine such as ClS-jasmine orjasmal, vanillin, and the like.

Chelant

The corrosion inhibiting compositions, or detergent compositions incorporating the same can also include a chelant at a level of from 0 wt. % to 50 wt. %, preferably from 0 wt. % to 30 wt. %, more preferably from 0 wt. % to 10 wt % by weight of total scale inhibiting composition. Chelation herein means the binding or complexation of a bi- or multidentate ligand. These ligands, which are often organic compounds, are called chelants, chelators, chelating agents, and/or sequestering agent. Chelating agents form multiple bonds with a single metal ion. Chelants, are chemicals that form soluble, complex molecules with certain metal ions, inactivating the ions so that they cannot normally react with other elements or ions to produce precipitates or scale. The ligand forms a chelate complex with the substrate. The term is reserved for complexes in which the metal ion is bound to two or more atoms of the chelant. The chelants for use in the present invention are those having crystal growth inhibition properties, i.e. those that interact with the small calcium and magnesium carbonate particles preventing them from aggregating into hard scale deposit. The particles repel each other and remain suspended in the water or form loose aggregates which may settle. These loose aggregates are easily rinse away and do not form a deposit.

Suitable chelating agents can be selected from the group consisting of amino carboxylates, amino phosphonates, polyfunctionally-substituted aromatic chelating agents and mixtures thereof. Preferred chelants for use herein are chelants such as the amino acids based chelants and preferably citrate, tartrate, and glutamic-N,N-diacetic acid and derivatives and/or phosphonate based chelants and preferably Diethylenetriamine penta methylphosphonic acid.

Other chelants include amino carboxylates include ethylenediaminetetra-acetates, N-hydroxyethylethylenediaminetriacetates, nitrilo-triacetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein. As well as MGDA (methylglycine-diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred.

Other suitable chelants include amino acid based compound or a succinate based compound. The term "succinate based compound" and "succinic acid based compound" are used interchangeably herein. Other suitable chelants are described in U.S. Pat. No. 6,426,229. Particular suitable chelants include; for example, aspartic acid-N-monoacetic acid (ASMA), aspartic acid-N,N-diacetic acid (ASDA), aspartic acid-N-monopropionic acid (ASMP), iminodisuccinic acid (IDS), Imino diacetic acid (IDA), N-(2-sulfomethyl)aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), .quadrature.-alanine-N,N-diacetic acid-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof. Also suitable is ethylenediamine disuccinate ("EDDS"), especially the [S,S] isomer as described in U.S. Pat. No. 4,704,233. Furthermore, Hydroxyethyleneiminodiacetic acid, Hydroxyiminodisuccinic acid, Hydroxyethylene diaminetriacetic acid is also suitable.

Other chelants include homopolymers and copolymers of polycarboxylic acids and their partially or completely neutralized salts, monomeric polycarboxylic acids and hydroxycarboxylic acids and their salts. Preferred salts of the abovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Preferred are the polycarboxylates end capped with sulfonates.

Amino phosphonates are also suitable for use as chelating agents and include ethylenediaminetetrakis(methylenephosphonates) as DEQUEST. Preferred, these amino phosphonates that do not contain alkyl or alkenyl groups with more than about 6 carbon atoms.

Polyfunctionally-substituted aromatic chelating agents are also useful in the compositions herein such as described in U.S. Pat. No. 3,812,044. Preferred compounds of this type in acid form are dihydroxydisulfobenzenes such as 1,2-dihydroxy-3,5-disulfobenzene.

Further suitable polycarboxylates chelants for use herein include citric acid, and succinic acid all preferably in the form of a water-soluble salt. Other suitable polycarboxylates are oxodisuccinates, carboxymethyloxysuccinate and mixtures of tartrate monosuccinic and tartrate disuccinic acid such as described in U.S. Pat. No. 4,663,071.

Enzymes

The composition of the invention may include one or more enzymes, which can provide desirable activity for removal of protein-based, carbohydrate-based, or triglyceride-based soils from substrates such as flatware, cups and bowls, and pots and pans. Enzymes suitable for the inventive composition can act by degrading or altering one or more types of soil residues encountered on a surface thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized, or otherwise more easily removed by detersive solutions containing said proteases. Exemplary types of enzymes include proteases, alpha-amylases, and mixtures thereof. Exemplary proteases that can be used include those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. A valuable reference on enzymes is "Industrial Enzymes," Scott, D., in Kirk-Othmer Encyclopedia of Chemical Technology, 3rd Edition, (editors Grayson, M. and EcKroth, D.) Vol. 9, pp. 173-224, John Wiley & Sons, New York, 1980. The concentrate need not include an enzyme. When the concentrate includes an enzyme, it can be included in an amount that provides the desired enzymatic activity when the warewashing composition is provided as a use composition. Exemplary ranges of the enzyme in the concentrate include between about 0 and about 15 wt. %, between about 0.5 wt. % and about 10 wt. %, and between about 1 wt. % and about 5 wt. %.

Anti-Etch Agents

The composition may also include an anti-etch agent capable of preventing etching in glass. Examples of suitable anti-etch agents include adding metal ions to the composition such as zinc, zinc chloride, zinc gluconate, aluminum, and beryllium. The composition preferably includes from about 0.1 wt. % to about 10 wt. %, more preferably from about 0.5 wt. % to about 7 wt. %, and most preferably from about 1 wt. % to about 5 wt. % of an anti-etch agent.

Hydrotrope Component

A hydrotrope component can be used to help stabilize the surfactant component. It should be understood that the hydrotrope component is optional and can be omitted if it is not needed for stabilizing the surfactant component. In many cases, it is expected that the hydrotrope component will be present to help stabilize the surfactant component. Examples of the hydrotropes include the sodium, potassium, ammonium and alkanol ammonium salts of xylene sulfonate, toluene sulfonate, ethylbenzoate sulfonate, isopropylbenzene, sulfonate naphthalene sulfonate, alkyl naphthalene sulfonates, phosphate esters of alkoxylated alkyl phenols, phosphate esters of alkoxylated alcohols, short chain ($C_8$ or less) alkyl polyglycoside, sodium, potassium and ammonium salts of the alkyl sarcosinates, salts of cumene sulfonates, amino propionates, diphenyl oxide sulfaontes, and disulfonates. The hydrotropes are useful in maintaining the organic materials including the surfactant readily dispersed in the aqueous cleaning solution and, in particular, in an aqueous concentrate which is an especially preferred form of packaging the compositions of the invention and allow the user of the compositions to accurately provide the desired amount of detergent composition.

Additional Corrosion Inhibitors

Additional corrosion inhibitors which may be optionally added to the detergent compositions of this invention include magnesium and/or zinc. Preferably, the metal ions are provided in water soluble form. Examples of useful water soluble forms of magnesium and zinc ions are the water soluble salts thereof including the chlorides, nitrates and sulfates of the respective metals. In order to maintain the dispersibility of the magnesium and/or zinc corrosion inhibitors in aqueous solution, and in the presence of agents which would otherwise cause precipitation of the zinc or magnesium ions, e.g., carbonates, phosphates, etc., it might be advantageous to include a carboxylated polymer to the solution.

Bleaching Agent

Bleaching agents for use in a cleaning compositions for lightening or whitening a substrate, include bleaching compounds capable of liberating an active halogen species, such as $Cl_2$, $Br_2$, $OCl^-$ and/or $OBr^-$, under conditions typically encountered during the cleansing process. Suitable bleaching agents for use in the present cleaning compositions include, for example, chlorine-containing compounds such as chlorine, hypochlorite, and/or chloramine. Exemplary halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition can include an effective amount of a bleaching agent. When the concentrate includes a bleaching agent, it can be included in an amount of about 0.1 wt. % to about 60 wt. %, about 1 wt. % to about 20 wt. %, about 3 wt. % to about 8 wt. %, and about 3 wt. % to about 6 wt. %.

Fillers

The composition can include an effective amount of detergent fillers, Examples of detergent fillers suitable for use in the present cleaning compositions include sodium sulfate, sodium chloride, starch, sugars, $C_1$-$C_{10}$ alkylene glycols such as propylene glycol, and the like. When the concentrate includes a detergent filler, it can be included an amount of about 1 wt. % to about 20 wt. % and between about 3 wt. % to about 15 wt. %.

Defoaming Agent

A defoaming agent for reducing the stability of foam may also be included in the composition to reduce foaming. When the concentrate includes a defoaming agent, the defoaming agent can be provided in an amount of between about 0.01 wt. % and about 3 wt. %.

Examples of defoaming agents that can be used in the composition includes ethylene oxide/propylene block copolymers silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Redeposition Agent

The composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. When the concentrate includes an anti-redeposition agent, the anti-redeposition agent can be included in an amount of between about 0.5 wt. % to about 10 wt. %, and between about 1 wt. % and about 5 wt. %.

Stabilizing Agents

Stabilizing agents that can be used include primary aliphatic amines, betaines, borate, calcium ions, sodium citrate, citric acid, sodium formate, glycerine, malonic acid, organic diacids, polyols, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include about 0 to about 20 wt. %, about 0.5 wt. % to about 15 wt. %, and about 2 wt. % to about 10 wt. %.

Dispersants

Dispersants that can be used in the composition include maleic acid/olefin copolymers, polyacrylic acid, and mixtures thereof. The concentrate need not include a dispersant, but when a dispersant is included it can be included in an amount that provides the desired dispersant properties. Exemplary ranges of the dispersant in the concentrate can be between about 0 and about 20 wt. %, between about 0.5 wt. % and about 15 wt. %, and between about 2 wt. % and about 9 wt. %.

Water

The concentrate can include water. In general, it is expected that water may be present as a processing aid and may be removed or become water of hydration. It is expected that water may be present in both the liquid concentrate and in the solid concentrate. In the case of the liquid concentrate, it is expected that water will be present in a range of between about 5 wt. % and about 60 wt. %, between about 10 wt. % and about 35 wt. %, and between about 15 wt. % and about 25 wt. %. In the case of a solid concentrate, it is expected that the water will be present in ranges of between about 10 wt. % and about 50 wt. %, about 15 wt. % and about 40 wt. %, about 20 wt. % and about 35 wt. %. It should be additionally appreciated that the water may be provided as deionized water or as softened water.

Use Compositions

The compositions of the present invention include concentrate compositions and use compositions. For example, a concentrate composition can be diluted, for example with water, to form a use composition. In an embodiment, a concentrate composition can be diluted to a use solution before to application to an object. For reasons of economics, the concentrate can be marketed and an end user can dilute the concentrate with water or an aqueous diluent to a use solution.

The level of active components in the concentrate composition is dependent on the intended dilution factor and the desired activity of the corrosion inhibition compound. Generally, a dilution of about 1 fluid ounce to about 10 gallons of water to about 10 fluid ounces to about 1 gallon of water is used for aqueous compositions of the present invention. In some embodiments, higher use dilutions can be employed if elevated use temperature (greater than 25° C.) or extended exposure time (greater than 30 seconds) can be employed. In the typical use locus, the concentrate is diluted with a major proportion of water using commonly available tap or service water mixing the materials at a dilution ratio of about 3 to about 40 ounces of concentrate per 100 gallons of water.

In other embodiments, a use composition can include about 0.01 to about 10 wt-% of a concentrate composition and about 90 to about 99.99 wt-% diluent; or about 0.1 to about 1 wt-% of a concentrate composition and about 99 to about 99.9 wt-% diluent. Amounts of an ingredient in a use composition can be calculated from the amounts listed above for concentrate compositions and these dilution factors. In some embodiments, for example when used in a laundry application, the concentrated compositions of the present invention are diluted such that the caustic is approximately 250 ppm, the citrate (adjuvant) is 100 ppm and acrylic polymer is 40 ppm and the Oligomeric Phosphinosuccinic Acid Adducts are present at approximately 30 ppm. It is to be understood that all values and ranges between these values and ranges are encompassed by the present invention.

The Warewash Process

The chemical cleaning method may be utilized in any of the conventional automatic institutional or domestic ware washing processes. Typical institutional ware washing processes are either continuous or non-continuous and are conducted in either a single tank or a multi-tank/conveyor type machine. In the conveyor system pre-wash, wash, post-rinse and drying zones are generally established using partitions. Wash water is introduced into the rinsing zone and is passed cascade fashion back towards the pre-wash zone while the dirty dishware is transported in a counter-current direction.

Typically, an institutional warewash machine is operated at a temperature of between 45-65° C. in the washing step and about 80-90° C. in the rinse step. The washing step typically does not exceed 10 minutes, or even does not exceed 5 minutes. In addition, the aqueous rinse step typically does not exceed 2 minutes. By the contrary, a consumer machine washing step can last from at least as 12 minutes to over 120 minutes.

It is envisaged to dose the detergent in the ware washing process in a concentrated version, e.g. using about 10% of the common amount of aqueous diluent, and to add the remaining 90% of the aqueous diluent in a later stage of the washing process, e.g. after 10 to 30 seconds contact time of the ware with the concentrated detergent.

The present application furthermore provides a method for washing ware in a traditional consumer ware wash/dishwashing machine using automatic warewashing compositions according to the invention, the automatic warewashing compositions preferably being dispensed into the interior of a warewashing machine during the performance of a warewashing program, before the start of the main washing cycle or in the course of the main washing cycle. Dispensing or introduction of the preparation according to the invention into the interior of the warewashing machine may proceed manually, but the preparation is preferably dispensed into the interior of the dishwashing machine by means of the dispensing chamber of the warewashing machine. Preferably, no additional water softener and no additional rinse aid is dispensed into the interior of the warewashing machine in the course of the washing method.

Forming a Concentrate

The components can be mixed and extruded or cast to form a solid such as pellets, powders or blocks. Heat can be applied from an external source to facilitate processing of the mixture.

A mixing system provides for continuous mixing of the ingredients at high shear to form a substantially homogeneous liquid or semi-solid mixture in which the ingredients are distributed throughout its mass. The mixing system includes means for mixing the ingredients to provide shear effective for maintaining the mixture at a flowable consistency. The mixing system can be a continuous flow mixer or a single or twin screw extruder apparatus.

The mixture can be processed at a temperature to maintain the physical and chemical stability of the ingredients, such as at ambient temperatures. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient. One or more premixes may be added to the mixture.

The ingredients are mixed to form a substantially homogeneous consistency wherein the ingredients are distributed substantially evenly throughout the mass. The mixture can be discharged from the mixing system through a die or other shaping means. The profiled extrudate can be divided into useful sizes with a controlled mass. The extruded solid can be packaged in film. The temperature of the mixture when discharged from the mixing system can be sufficiently low to enable the mixture to be cast or extruded directly into a packaging system without first cooling the mixture. The time between extrusion discharge and packaging can be adjusted to allow the hardening of the detergent block for better handling during further processing and packaging. The mixture at the point of discharge can be about 20-90° C., and about 25-55° C. The composition can be allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20-90° C.

When processing of the ingredients is completed, the mixture may be discharged from the mixer through a discharge die. The solidification process may last from a few minutes to hours, depending, for example, on the size of the cast or extruded composition, the ingredients of the composition, the temperature of the composition, and other like factors. Preferably, the cast or extruded composition "sets up" or begins to harden to a solid form within about 1 minute to about 3 hours, preferably about 1 minute to about 2 hours, most preferably about 1 minute to about 1.0 hours minutes.

The concentrate can be provided in the form of a liquid. Various liquid forms include gels and pastes. Of course, when the concentrate is provided in the form of a liquid, it is not necessary to harden the composition to form a solid. In fact, it is expected that the amount of water in the composition will be sufficient to preclude solidification. In addition, dispersants and other components can be incorporated into the concentrate in order to maintain a desired distribution of components.

The packaging receptacle or container may be rigid or flexible, and composed of any material suitable for containing the compositions produced according to the invention, as for example glass, metal, plastic film or sheet, cardboard, cardboard composites, paper, and the like. The composition is processed at around 150-170° F. and are generally cooled to 100-150° before packaging. so that processed mixture may be cast or extruded directly into the container or other packaging system without structurally damaging the material. As a result, a wider variety of materials may be used to manufacture the container than those used for compositions that processed and dispensed under molten conditions.

The packaging material can be provided as a water soluble packaging material such as a water soluble packaging film. Exemplary water soluble packaging films are disclosed in U.S. Pat. Nos. 6,503,879; 6,228,825; 6,303,553; 6,475,977; and 6,632,785, the disclosures of which are incorporated herein by reference. An exemplary water soluble polymer that can provide a packaging material that can be used to package the concentrate includes polyvinyl alcohol. The packaged concentrate can be provided as unit dose packages or multiple dose packages. In the case of unit dose packages, it is expected that a single packaged unit will be placed in a dishwashing machine, such as the detergent compartment of the dishwashing machine, and will be used up during a single wash cycle. In the case of a multiple dose package, it is expected that the unit will be placed in a hopper and a stream of water will erode a surface of the concentrate to provide a liquid concentrate that will be introduced into the dishwashing machine.

The present hard water control composition can be provided in any of a variety of embodiments of detergent or treatment compositions.

A solid cleaning composition as used in the present disclosure encompasses a variety of forms including, for example, solids, pellets, blocks, tablets, and powders. By way of example, pellets can have diameters of between about 1 mm and about 10 mm, tablets can have diameters of between about 1 mm and about 10 mm or between about 1 cm and about 10 cm, and blocks can have diameters of at least about 10 cm. It should be understood that the term "solid" refers to the state of the cleaning composition under the expected conditions of storage and use of the solid cleaning composition. In general, it is expected that the cleaning composition will remain a solid when provided at a temperature of up to about 100° F. or lower than about 120° F.

In certain embodiments, the solid cleaning composition is provided in the form of a unit dose. A unit dose refers to a solid cleaning composition unit sized so that the entire unit is used during a single cycle, for example, a single washing cycle of a warewash machine. When the solid cleaning composition is provided as a unit dose, it can have a mass of about 1 g to about 50 g. In other embodiments, the composition can be a solid, a pellet, or a tablet having a size of about 50 g to 250 g, of about 100 g or greater, or about 40 g to about 11,000 g.

In other embodiments, the solid cleaning composition is provided in the form of a multiple-use solid, such as, a block or a plurality of pellets, and can be repeatedly used to generate aqueous cleaning compositions for multiple washing cycles. In certain embodiments, the solid cleaning composition is provided as a solid having a mass of about 5 g to about 10 kg. In certain embodiments, a multiple-use form of the solid cleaning composition has a mass of about 1 to about 10 kg. In further embodiments, a multiple-use form of the solid cleaning composition has a mass of about 5 kg to about 8 kg. In other embodiments, a multiple-use form of the solid cleaning composition has a mass of about 5 g to about 1 kg, or about 5 g and to about 500 g.

While the invention is described in the context of a warewashing composition for washing articles in an automatic dishwashing machine, it should be understood that the detergent compositions employing the scale control composition can be used for washing non-ware items. That is, the warewashing composition can be referred to as a cleaning composition and can be used to clean various items. It should be understood that certain components that may be included in a warewashing composition because it is intended to be used in an automatic dishwashing machine can be excluded from a cleaning composition that is not intended to be used in an automatic dishwashing machine, and vice versa. For example, surfactants that have a tendency to create quite a bit of foaming may be used in a cleaning composition that is not intended to be used in an automatic dishwashing machine.

Exemplary ranges of the warewashing composition in its simplest aspect include a source of alkalinity and the Phosphinosuccinic oligomer mixture. The source of alkalinity typically comprises between a first range of 30-99 wt. % a second range of 35-80 wt. % and a third range of 40-70%. The Phosphinosuccinic Oligomers are present in an amount of a first range of 1-10 wt. % a second range of 2-8 wt. According to certain embodiments, an acrylic co polymer is present in an amount of from 1-25 wt. %, or 5-20 wt. % or in a third range, 10-15 wt. %. Also present may be an adjuvant in an amount of from about 5 wt. %-30 wt. %, 10-25 wt. %, or 15-20 wt. %. The composition can also include water and additional excipients which make up the remainder.

At use concentration the composition generally includes from about 5 to about 300 ppm of the phosphinosuccinic acid oligomer or mixtures thereof; from about 5 to about 300 ppm of the acrylic copolymer; from about 10 to about 5000 ppm adjuvant and from about 100 to 3000 ppm alkalinity. In a preferred embodiment the composition includes 10 to about 200 ppm of the phosphinosuccinic oligomer or mixture thereof; from about 10 to about 200 ppm of the acrylic copolymer; from about 100 to about 3000 ppm adjuvant and from about 200 to 2000 ppm alkalinity. In a more preferred embodiment the composition includes from about 20 to about 100 ppm of the phosphinosuccinic acid oligomer or mixture thereof; from about 20 to about 100 ppm of the acrylic copolymer; from about 500 to about 2000 ppm adjuvant and from about 300 to 1500 ppm alkalinity.

The above specification provides a basis for understanding the broad meets and bounds of the invention. The following examples and test data provide an understanding of certain specific embodiments of the invention. The examples are not meant to limit the scope of the invention that has been set forth in the foregoing description. Variations within the concepts of the invention are apparent to those skilled in the art.

Example 1

A 13"×9" aluminum sheet pan was obtained by cutting a 13"×18" pan in half. The pan was lightly cleaned with warm soapy water and a non-abrasive sponge to ensure any foreign materials or residues from cutting and storage were removed. Next a dishwasher was filled with water. The Machine was then primed with the desired concentration of detergent and the pan was placed in the lower section with the rim facing down and cut edge facing up, two glasses were placed on the upper section.

Next the machine was started and a long cycle was set. At the beginning of each cycle, the appropriate amount of detergent was added to the wash tank. The steps were repeated until the desired number of cycles were completed.

The typical use concentration of the carbonate, PSO, Copolymer, and the adjuvant is:

PSO: 40 ppm

Copolymer: 40 ppm

Adjuvant: 950 ppm

Sodium Carbonate: 1200 ppm

Commercial aluminum trays were used after been cut in half.

Five cycles were run with above formulation, and glasses were also placed inside the ware washing commercial machine.

The aluminum tray weight was:

| | | |
|---|---|---|
| Initial | 412.48 g | |
| First cycle | 411.88 g | (0.145% weight loss) |
| Fifth cycle | 411.82 g | (0.16% total weight loss, and 0.015% loss from the 1st cycle) |

Figure 1B:
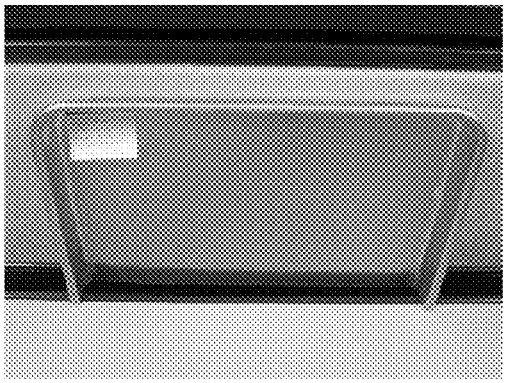
Figure 1C:
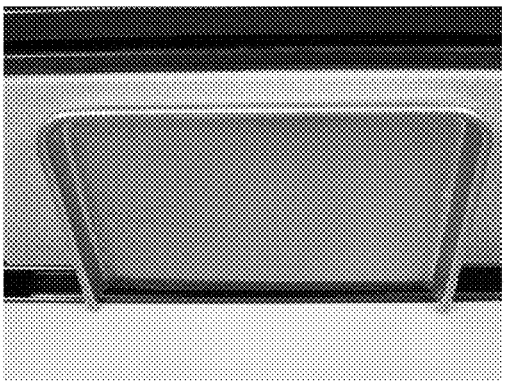
Figure 1D:
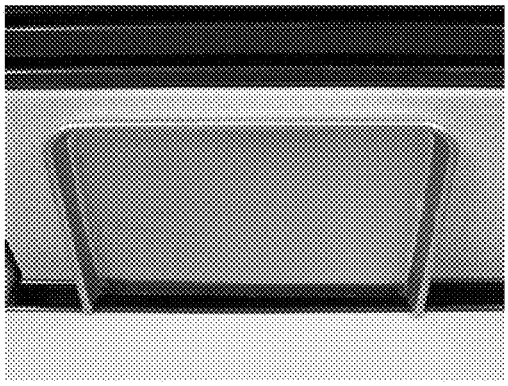
Figure 1E:
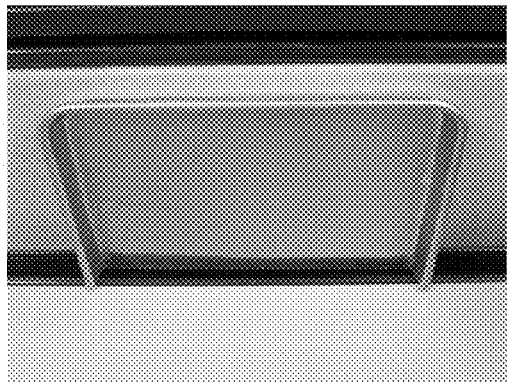
Figure 2:
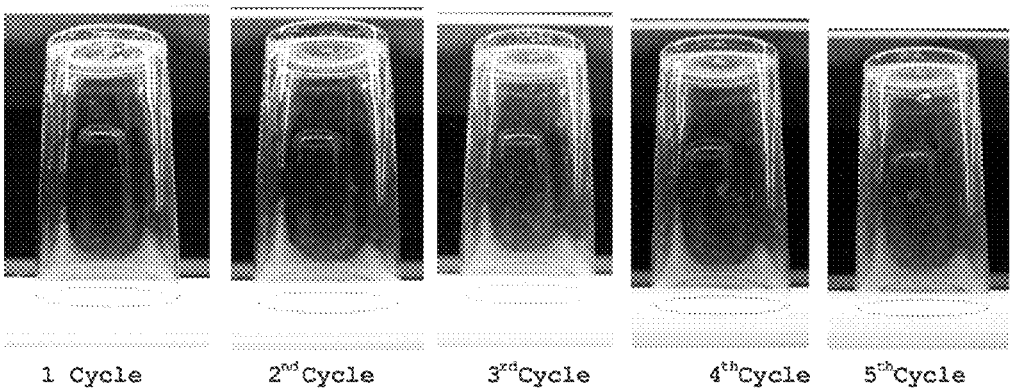
FIG. 2 is a photograph showing glass cleaning with the detergent formulation of the invention. Here again, all glasses show no sign of corrosion or etch, and appear similar to the comparison glass at the far right.

The results for aluminum trays are shown in FIGS. 1A-1E. One can see that the trays are clean with no evidence of corrosion or damage evidenced by the similar weight after 5 cleaning cycles.

What is claimed is:

1. A detergent composition for use comprising:

(a) a consumer friendly alkaline source;

(b) a corrosion inhibitor component in an amount sufficient for reducing corrosion of aluminum, tin or aluminum or tin containing alloys, the corrosion inhibitor component comprising a phosphinosuccinic acid oligomer, or mixtures thereof, including their salt forms, wherein said phosohinosuccinic acid oligomer comprises a mixture of about 5 to about 25 wt. % of monosodium phosohinicosuccinic acid, from about 20 to about 60 wt. % of monosodium phosphinicobis(succini) acid and from about 40 to 75 wt. % of a phosphinicopolysuccinic acid;

(c) an acrylic copolymer; and (d) an adjuvant.

2. The detergent composition according to claim 1 wherein said acrylic copolymer is a copolymer of acrylic and AMPS monomers.

3. The detergent composition according to claim 1, wherein adjuvant comprises one or more of the following a carboxylate, a polycarboxylate, an amino acid, a hydroxycarboxylate, polyhydroxicarboxylate, a chelant, a polyhydroxide, a silicate, a phosohate a polyphosphate and/or their acids and salts.

4. The detergent composition according to claim 1, wherein adjuvant comprises catechol, curcumin, tiron, maleic acid, tartaric acid, saccharates, phthalic acid, lactic acid, glucose, salicylic acid, malic acid, mucic acid, gluconic acid, aspartic acid, methoxycathecol, oxalic acid, polyaspartic acid, EDTA, MGDA, and/or GLDA.

5. The detergent composition according to claim 1, wherein the alkaline source comprises sodium carbonate.

6. The detergent composition of claim 1 wherein said phosphinosuccinic acid oligomer is between about 1 wt. % and about 10 wt. % of the detergent composition.

7. The detergent composition of claim 1 wherein said detergent includes from about 5 to about 300 ppm of the phosphinosuccinic acid oligomer.

8. The detergent composition of claim 1 wherein said detergent includes from about 5 to about 300 ppm of the acrylic copolymer.

9. The detergent composition of claim 1 wherein said detergent includes from about 10 to about 5000 ppm of adjuvant.

10. The detergent composition of claim 1 wherein said consumer friendly alkaline source is present in an amount of from 100 to about 3000 ppm.

11. A warewash detergent composition with aluminum protection comprising:

from about 1 wt. % to about 10 wt. % of a phosphinosuccinic acid oligomer wherein said phosphinosuccinic acid oligomer comprises a mixture of about 5 to about 25 wt. % of monosodium phosphinicosuccinic acid, from about 20 to about 60 wt. % of monosodium phosphinicobis(succinic) acid and from about 40 to 75 wt. % of a phosphinicopolysuccinic acid;

from about 1 wt. % to about 25 wt. % of acrylic copolymer;

from about 5 wt. % to about 30 wt. % of adjuvant which includes silicate and from about 30 to about 99 wt. % of carbonate with water and additional components making up the remainder.

12. The detergent of claim 11 wherein said acrylic copolymer is a copolymer of acrylic and AMPS monomers.

13. The detergent of claim 11 wherein said copolymer includes from about 10 wt. % to about 80 wt. % of acrylic monomers and from about 1 wt. % to about 40 wt. % of AMPS.

14. The detergent of claim 10 wherein said phosphinosuccinic acid oligomer is between about 2 wt. % and about 8 wt. % of the detergent composition.

15. A method for cleaning and protecting aluminum or aluminum containing alloys from corrosion in a consumer warewash method comprising:

(a) providing the composition of claim 11 to said aluminum product and thereafter;

(b) rinsing said composition from said product.

16. The method of claim 15 wherein said acrylic copolymer is a copolymer of acrylic and AMPS monomers.

17. The method of claim 15 wherein said adjuvant is sodium citrate.

18. The method of claim 15 wherein said composition further contains sodium hydroxide.

19. The method of claim 15 wherein said phosphinosuccinic acid oligomer is between about 2 wt. % and about 8 wt. % of the composition.

20. The detergent of claim 11 wherein said detergent is a solid.

* * * * *

UNITED STATES PATENT AND TRADEMARK OFFICE

CERTIFICATE OF CORRECTION

PATENT NO. : 9,023,779 B2
APPLICATION NO. : 13/834219
DATED : May 5, 2015
INVENTOR(S) : Altony J. Miralles It is certified that error appears in the above-identified patent and that said Letters Patent is hereby corrected as shown below:

In the Claims

Col. 29, Claim 1, Line 12:
DELETE after phosphinicobis "(succini)"
Add after phosphinicobis "(succinic)"

Signed and Sealed this
Twentieth Day of October, 2015

Michelle K. Lee

Michelle K. Lee
*Director of the United States Patent and Trademark Office*